US007455113B2

(12) United States Patent
Booth

(10) Patent No.: US 7,455,113 B2
(45) Date of Patent: Nov. 25, 2008

(54) DOWNHOLE IMPELLER DEVICE

(75) Inventor: Richard Keith Booth, Isle of Man (GB)

(73) Assignee: Hamdeen Incorporated Limited, Onchan (IM)

( * ) Notice: Subject to any disclaimer, the term of this patent is extended or adjusted under 35 U.S.C. 154(b) by 128 days.

(21) Appl. No.: 11/515,951

(22) Filed: Sep. 6, 2006

(65) Prior Publication Data

US 2007/0056773 A1 Mar. 15, 2007

(30) Foreign Application Priority Data

Sep. 6, 2005 (GB) ..... 0518109.4

(51) Int. Cl.
*E21B 21/00* (2006.01)
*E21B 37/00* (2006.01)

(52) U.S. Cl. ..... 166/312; 166/173; 166/177.7; 175/323; 175/324

(58) Field of Classification Search ..... 175/323, 175/324; 166/312, 173, 177.7
See application file for complete search history.

(56) References Cited

U.S. PATENT DOCUMENTS 2,246,418 A * 6/1941 Froome et al. ..... 175/323
3,085,639 A * 4/1963 Fitch ..... 175/323
3,194,331 A * 7/1965 Arnold ..... 175/323
4,049,066 A * 9/1977 Richey ..... 175/323
4,248,411 A * 2/1981 Wagster et al. ..... 269/67
4,747,452 A 5/1988 Clark
4,811,800 A * 3/1989 Hill et al. ..... 175/323
5,040,620 A * 8/1991 Nunley ..... 175/61
5,937,957 A * 8/1999 Swietlik ..... 175/323
6,056,073 A * 5/2000 Boulet ..... 175/323
6,227,291 B1 * 5/2001 Carmichael et al. ..... 166/170
6,349,779 B1 * 2/2002 Gilbert ..... 175/323
6,575,239 B2 * 6/2003 Allen ..... 166/170
6,695,058 B1 2/2004 French
2001/0030046 A1 10/2001 Haseloh

FOREIGN PATENT DOCUMENTS

GB 2412393 A 9/2005

* cited by examiner

*Primary Examiner*—Hoang Dang
(74) *Attorney, Agent, or Firm*—Finnegan, Henderson, Farabow, Garrett & Dunner LLP

(57) ABSTRACT

A downhole impeller device for use within a well, comprising: a body connectable to a drill string and having an external diameter smaller than the well diameter so as to form an annulus between the body and the well; and one or more impeller members extending from the outer surface of the body such that rotation of the or each impeller member impels drilling fluid within the annulus.

28 Claims, 2 Drawing Sheets

DOWNHOLE IMPELLER DEVICE

The present invention relates to downhole tools. In particular, but not exclusively, the invention relates to downhole cleaning and drilling tools connectable within a drill string.

During drilling of a well, drilling fluid is typically circulated to remove debris from the well. The drilling fluid is pumped down the internal bore of the drill string to the bit and returns in the annulus between the drill string and the well casing. However, this cleaning process can be inefficient under certain circumstances.

Some particles, because of their size or specific weight, are not readily transported by the drilling fluid. Also, due to boundary effects or temperature differentials, the viscosity of the drilling fluid tends to decrease as the distance from the drill string (and towards the casing) increases.

A particular problem exists when deviated drilling is performed. In an angled well, debris tends to settle at the lower side of the well. A common approach to solving this problem is to increase the speed of rotation of the drill string so as to cause greater agitation of the drilling fluid. However, this approach increases the wear and tear on the drill string and ancillary equipment.

Furthermore, the agitation achieved is substantially a local effect and will only tend to occur in the proximity of the drill bit. This is because of the greater diameter of the drill bit relative to the rest of the drill string. The drill string can be reciprocated as well as rotated but only up to the physical limit of the surface equipment, which is typically around 27 meters. Debris which has traveled further than this distance will again tend to settle as the localised effect diminishes.

According to a first aspect of the present invention, there is provided a downhole impeller device for use within a well, comprising:

a body connectable to a drill string and having an external diameter smaller than the well diameter so as to form an annulus between the body and the well; and one or more impeller members extending from the outer surface of the body such that rotation of the or each impeller member impels drilling fluid within the annulus.

Preferably the or each impeller member includes an impeller surface which is orientated at an oblique angle relative to the longitudinal axis of the body. Preferably the or each impeller member includes an impeller surface which is orientated at an oblique angle relative to a plane which is normal to the longitudinal axis of the body.

Preferably the device includes a plurality of impeller members. Preferably the or each impeller member extends from the outer surface of the body such that the end portion of the or each impeller member is substantially adjacent to the well. It is to be appreciated that the well may include a plurality of casing sections. Also, the well may be an angled well.

Preferably the device includes a first stabilising member. Preferably the first stabilising member comprises a plurality of fins extending from the body towards the well. Preferably the first stabilising member is adapted to have a diameter smaller than the diameter of the well. Preferably the first stabilising member is provided above the or each impeller member.

Preferably the device includes a second stabilising member. Preferably the second stabilising member comprises a plurality of fins extending from the body towards the well. Preferably the second stabilising member is adapted to have a diameter smaller than the diameter of the well. Preferably the second stabilising member is provided below the or each impeller member.

Preferably the or each impeller member defines an outer diameter which is smaller than the outer diameter of one or both of the first and second stabilising members.

Preferably the or each impeller member is adapted to impel drilling fluid within the annulus towards the surface. Preferably the or each impeller member is adapted to impel drilling fluid within the annulus in a radial direction. Preferably the or each impeller member is further adapted to impel drilling fluid within the annulus outwardly towards the surface of the well.

Preferably the or each impeller member defines one or more channels. Preferably the or each channel is substantially helical. The or each channel may be continuous or discontinuous.

Preferably the device includes pumping means. Preferably the or each impeller member provides the pumping means. Preferably the or each channel is tapered such that the velocity of drilling fluid exiting the or each channel is increased. Alternatively or in addition, the or each impeller member may define a tapering throat portion of the or each channel such that the velocity of drilling fluid exiting the or each channel is increased.

Preferably the device includes agitating means such that the flow of drilling fluid within the annulus is made more turbulent. Preferably the or each impeller member provides the agitating means.

Preferably the device includes an internal fluid passage provided in the body, the passage having an upper inlet and a lower outlet.

According to a second aspect of the present invention, there is provided a drill string including a downhole impeller device according to the first aspect of the invention.

Preferably a plurality of downhole impeller devices are provided. Preferably each device is spaced apart at a distance of between 20 and 40 meters, most preferably at a distance of between 25 and 30 meters.

According to a third aspect of the present invention, there is provided a method of removing debris within a well, comprising:

pumping drilling fluid down a drill string located within the well such that the drilling fluid returns to the surface via the annulus defined by the outer surface of the drill string and the inner surface of the well; and providing one or more impeller members at the outer surface of the drill string such that rotation of the or each impeller member impels fluid within the annulus.

Preferably the method includes orientating an impeller surface of the or each impeller member at an oblique angle relative to the longitudinal axis of the drill string. Preferably the method includes orientating an impeller surface of the or each impeller member at an oblique angle relative to a plane normal to the longitudinal axis of the drill string.

Preferably the method includes impelling drilling fluid within the annulus in a radial direction. Preferably the method includes impelling drilling fluid within the annulus outwardly towards the surface of the well.

Preferably the method includes adapting the or each impeller member to provide pumping means such that the velocity of drilling fluid impelled by the or each impeller member is increased.

Preferably the method includes agitating the flow of drilling fluid within in the annulus such that it is made more turbulent. Preferably the method includes adapting the or each impeller member to provide the agitating means.

Preferably the method includes providing a plurality of impeller members at the outer surface of the drill string. Preferably the method includes spacing each device at a distance of between 20 and 40 meters, most preferably at a distance of between 25 and 30 meters. Preferably the method includes reciprocating the drill string.

Preferably the method is performed in an angled well.

An embodiment of the present invention will now be described, by way of example only, with reference to the accompanying drawings, in which.

Figure 1:
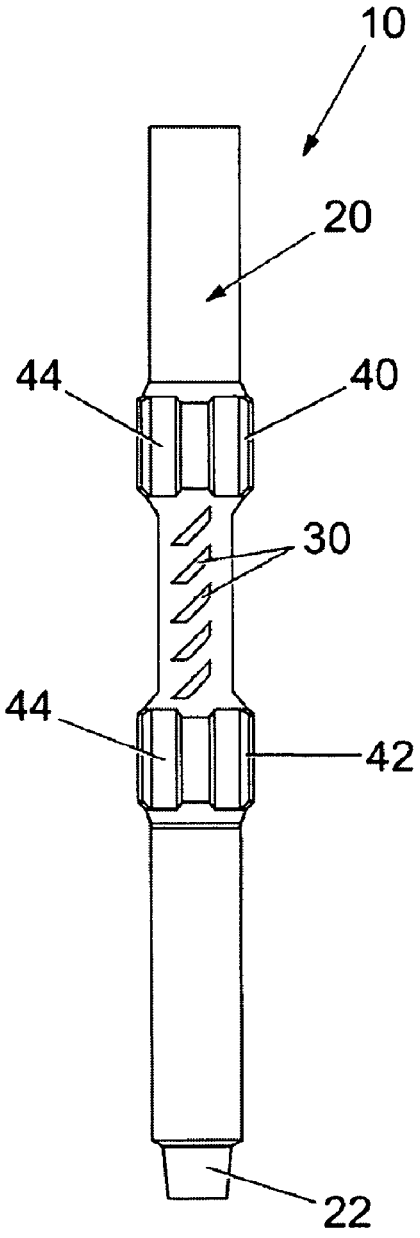
FIG. 1 shows a side view of a downhole impeller device according to the present invention.
Figure 2:
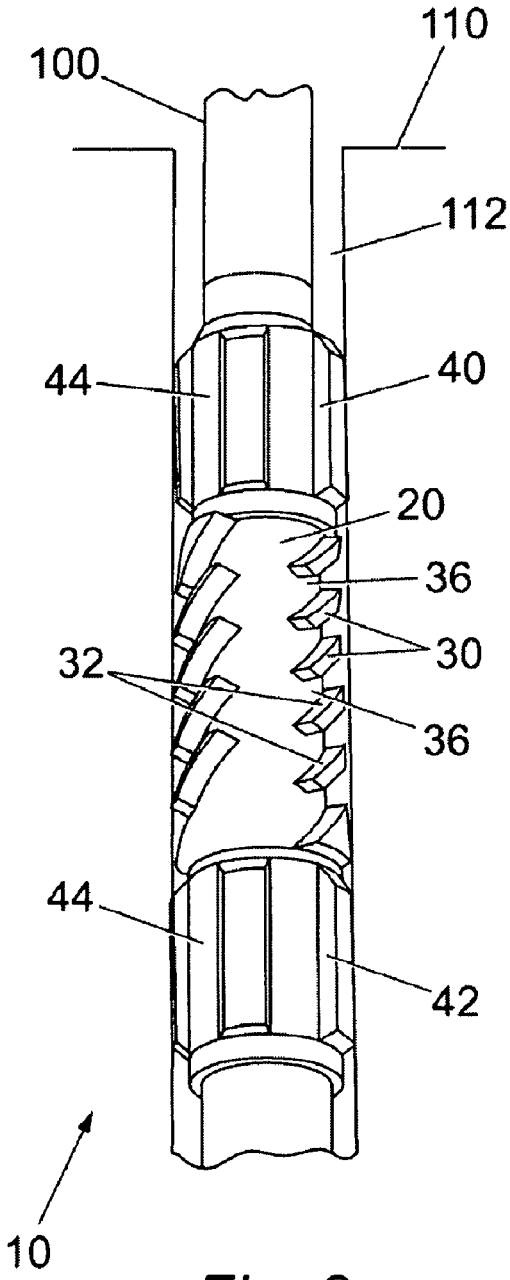
FIG. 2 shows a side view of the device of FIG. 1 within a well.

FIGS. 1 and 2 show a downhole impeller device 10 which comprises a body 20 which is connectable to a drill string 100 using threaded connections 22.

As shown in FIG. 2, when the device 10 is located in a typical well 110, the body 20 has an external diameter which is smaller than the well diameter. This defines an annulus 112 between the body 20 and well 110. The device 10 also includes a number of impeller members or blades 30 which extend from the outer surface of the body 20 towards the inner surface of the well 110. However, the blades 30 do not extend far enough to make contact with the inner surface of the well 110.

FIG. 2 shows a vertical well 110. However, the invention has particular advantages when operated in an angled well. The well may be uncased, such as when drilling the well, or may be cased such as during normal extraction from the well 110.

Each of the blades includes an impeller surface 32 which is at an oblique angle 34 relative to the longitudinal axis 24 of the body 20. Each impeller surface 32 is also orientated at an oblique angle relative to a plane which is normal to the longitudinal axis 24 of the body 20. Therefore, when the body 20 and blades 30 are rotated, the blades 30 impel drilling fluid within the annulus 112, and any debris entrained within the fluid, towards the surface.

The device 10 includes first 40 and second 42 stabilising members which are provided above and below the blades 30, respectively. Each of the first and second stabilising members include a number of fins 44 which extend from the body 20 to contact the well 110. The outer diameter of the first 40 and second 42 stabilising members is smaller than the inner diameter of the well 110 but greater than the outer diameter of the blades 30.

Each of the blades 30 may also be adapted to impel drilling fluid within the annulus 112 towards the inner surface of the well 110. The skilled person will be aware of a number of means for achieving this, such as an appropriate profile of the blades 30 or using centrifugal force.

Collectively, the blades 30 define a number of helical channels 34, although the channels need not be continuous. The blades 30 therefore impel drilling fluid within the annulus 112, and any debris entrained within the fluid, in a radial direction. In an angled well in particular, this has the advantage of moving debris radially from the low side to the high side of the drill string 100. This tends to be the region of greatest fluid flow and so debris will be moved radially into this region and tend to become entrained in this flow.

Figure 3:
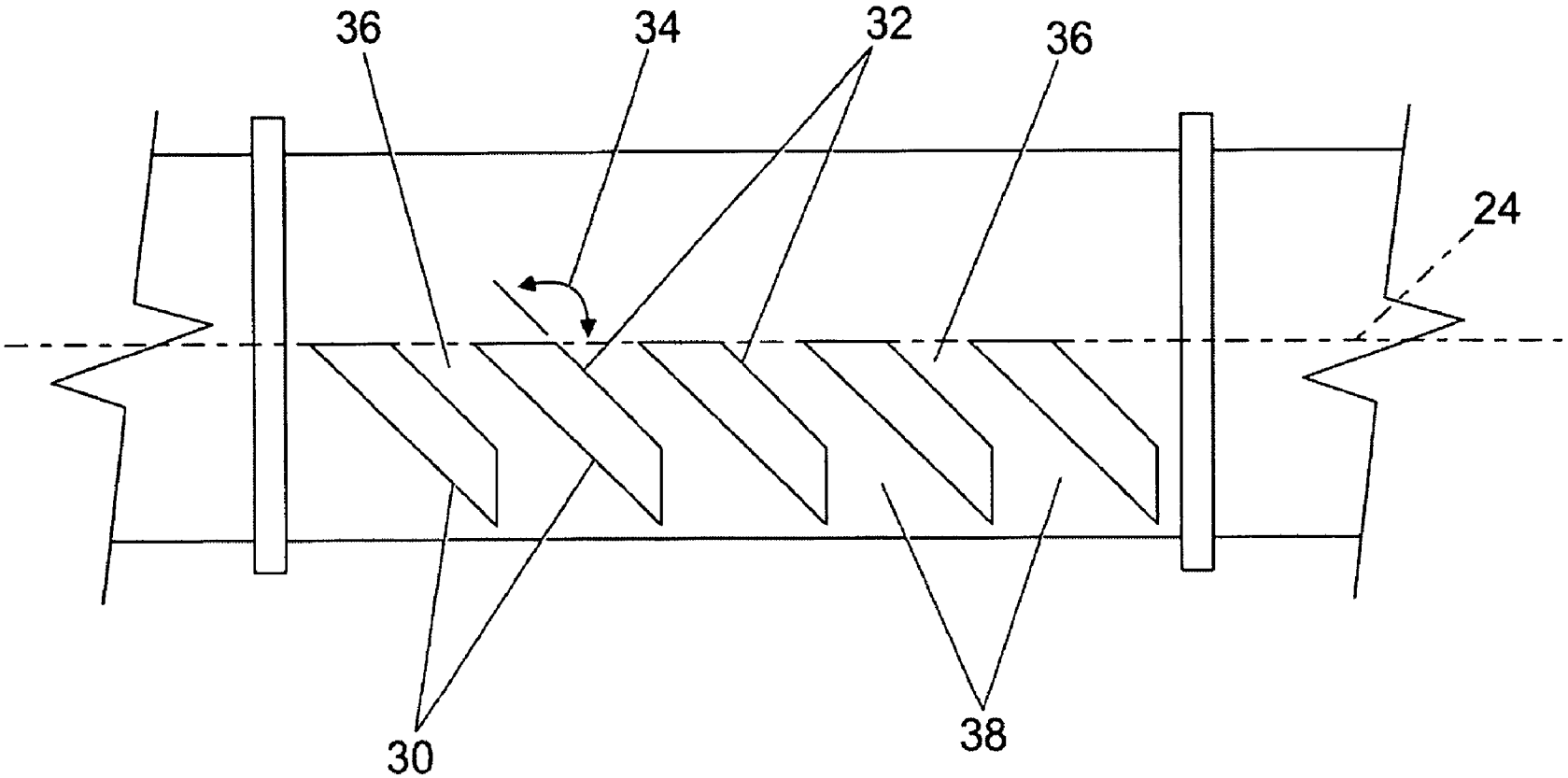
FIG. 3 shows a side view of a portion of the device of FIG. 1.

As shown in FIG. 3, the shape of the blades 30 defines a tapering throat portion 38 of the channels 36. This causes the velocity of drilling fluid exiting the channels 36 to increase.

The profile of the blades 30 may also be adapted to agitate fluid in the vicinity of the blades such that the flow of the drilling fluid is made more turbulent in this vicinity. Again, the skilled person will be aware of a number of ways of achieving this.

As with the conventional means of using the drill bit and increased rotation rate to agitate the fluid, the effect of the impeller device tends to be localised. However, a number of impeller devices can be provided on the drill string, typically the devices being spaced apart at a distance of around 27 meters. Thus, when the drill string 100 is reciprocated up to the physical limit of the surface equipment, impelling and agitation of the drilling fluid is achieved for the entire depth of the well.

In use, the present invention may be used during drilling or cleaning of a well 110 for the improved removal of debris within the well 110. Drilling fluid is pumped down the drill string 100 and returns to the surface via the annulus 112. Rotation of the drill string 100 causes rotation of each impeller device 10, and the blades 30 of each device in particular. This rotation, due to the profile of each blade 30, causes impelling of the drilling fluid within the annulus 112 in the vicinity of the respective device 10. This impelling of fluid tends to prevent debris in the vicinity of the device 10 from settling. This effect is enhanced by adapting the blades 30 to also impel fluid outwardly towards the inner surface of the well 110, to increase the velocity of the fluid in a direction parallel to the longitudinal axis 24 of the drill string 100, and to agitate the fluid such that the flow of the fluid is more turbulent. Although this effect is localised, reciprocation of the drill string 100 results in this effect taking place for the entire depth of the well 110 such that debris is never allowed to settle at a particular depth within the well 110.

Various modifications and improvements can be made without departing from the scope of the present invention.

The invention claimed is:

1. A downhole impeller device for use within a well having a well diameter and a surface, the device comprising:

a body connectable to a drill string and having an outer surface and an external diameter smaller than the well diameter so as to form an annulus between the body and the well such that drill fluid may flow within the drill string and within the annulus; and at least two impeller members extending from the outer surface of the body such that rotation of the at least two impeller members impels drilling fluid within the annulus, wherein the at least two impeller members defines at least one channel therebetween, the channel including an inwardly tapering throat portion such that the velocity of drilling fluid exiting the at least one channel is increased.

2. A downhole impeller device as claimed in claim 1, wherein the ody has a longitudinal axis, and wherein at least one impeller member includes an impeller surface which is oriented at an oblique angle relative to the longitudinal axis of the body.

3. A downhole impeller device as claimed in claim 1, wherein at least one impeller member includes an impeller surface which is oriented at an oblique angle relative to a plane which is normal to the longitudinal axis of the body.

4. A downhole impeller device as claimed in claim 1, wherein each impeller member has an end portion, and wherein each impeller member extends from the outer surface of the body such that the end portion of each impeller member is substantially adjacent to the well.

5. A downhole impeller device as claimed in claim 1, wherein the well includes a plurality of casing sections.

6. A downhole impeller device as claimed in claim 1, wherein the well is an angled well.

7. A downhole impeller device as claimed in claim 1, including a first stabilising member comprising a plurality of fins extending from the body towards the well.

8. A downhole impeller device as claimed in claim 7, wherein the first stabilising member is provided above at least one impeller member.

9. A downhole impeller device as claimed in claim 7, including a second stabilising member comprising a plurality of fins extending from the body towards the well.

10. A downhole impeller device as claimed in claim 9, wherein the second stabilising member is provided below at least one impeller member.

11. A downhole impeller device as claimed in claim 9, wherein at least one of the first and second stabilising members defines a first outer diameter and at least one impeller member defines a second outer diameter, and wherein the second outer diameter is smaller than the first outer diameter.

12. A downhole impeller device as claimed in claim 1, wherein at least one impeller member is adapted to impel drilling fluid within the annulus towards the surface.

13. A downhole impeller device as claimed in claim 1, wherein at least one impeller member is adapted to impel drilling fluid within the annulus in a radial direction outwardly from the body.

14. A downhole impeller device as claimed in claim 1, wherein at least one channel is substantially helical.

15. A downhole impeller device as claimed in claim 1, including pumping means.

16. A downhole impeller device as claimed in claim 15, wherein at least one impeller member provides the pumping means.

17. A downhole impeller device as claimed in claim 1, including agitating means such that the flow of drilling fluid within the annulus is made more turbulent.

18. A downhole impeller device as claimed in claim 17, wherein at least one impeller member provides the agitating means.

19. A drill string including a downhole impeller device according to claim 1.

20. A drill string as claimed in claim 19, wherein a plurality of downhole impeller devices are provided.

21. A drill string as claimed in claim 20, wherein each device is spaced apart at a distance of between 25 and 30 meters.

22. A method of removing debris within a well having a well diameter and an inner surface, the method comprising:

providing a drill string having an outer surface within the well such that the outer surface of the drill string and the inner surface of the well define an annulus;

pumping drilling fluid down the drill string such that the drilling fluid returns via the annulus; and providing a downhole impeller device such that rotation of the downhole impeller device impels fluid within the annulus, wherein the downhole impeller device comprises a body connectable to the drill string and having the outer surface and an external diameter smaller than the well diameter so as to form the annulus between the body and the well such that drill fluid may flow within the drill string and within the annulus, and at least two impeller members extending from the outer surface of the body such that rotation of the at least two impeller members causes the rotation, the at least two impeller members defining at least one channel therebetween, the channel including an inwardly tapering throat portion such that the velocity of drilling fluid exiting the at least one channel is increased.

23. A method as claimed in claim 22, including impelling drilling fluid within the annulus in a radial direction outwardly towards the inner surface of the well.

24. A method as claimed in claim 22, including adapting at least one impeller member to provide pumping means such that the velocity of drilling fluid impelled by at least one impeller member is increased.

25. A method as claimed in claim 22, including agitating the flow of drilling fluid within the annulus such that it is made more turbulent.

26. A method as claimed in claim 22, including providing a plurality of impeller members at the outer surface of the drill string, and spacing at least one impeller member from another at least one impeller member by a distance of between 25 and 30 meters.

27. A method as claimed in claim 22, including reciprocating the drill string.

28. A method as claimed in claim 22, performed in an angled well.

* * * * *